US011415314B2

(12) United States Patent
Albrecht et al.

(10) Patent No.: US 11,415,314 B2
(45) Date of Patent: Aug. 16, 2022

(54) NATURAL CIRCULATION MULTI-CIRCULATION PACKAGE BOILER WITH SUPERHEAT FOR STEAM ASSISTED GRAVITY DRAINAGE (SAGD) PROCESS INCLUDING SUPERHEAT

(71) Applicant: THE BABCOCK & WILCOX COMPANY, Barberton, OH (US)

(72) Inventors: Melvin J Albrecht, Homeworth, OH (US); Jason M Marshall, Wadsworth, OH (US); Jeremy L Remus, Uniontown, OH (US)

(73) Assignee: The Babcock & Wilcox Company, Akron, OH (US)

( * ) Notice: Subject to any disclaimer, the term of this patent is extended or adjusted under 35 U.S.C. 154(b) by 378 days.

(21) Appl. No.: 16/445,721

(22) Filed: Jun. 19, 2019

(65) Prior Publication Data

US 2020/0400305 A1 Dec. 24, 2020

(51) Int. Cl.

| | |
|---|---|
| ***F22B 1/22*** | (2006.01) |
| ***F22B 21/34*** | (2006.01) |
| ***F22G 7/14*** | (2006.01) |

(52) U.S. Cl.

CPC ..... *F22B 1/22* (2013.01); *F22B 21/34* (2013.01); *F22G 7/14* (2013.01)

(58) Field of Classification Search

CPC ..... F22B 1/22

See application file for complete search history.

(56) References Cited

U.S. PATENT DOCUMENTS

| | | | | |
|---|---|---|---|---|
| 7,533,632 | B2 * | 5/2009 | Stone | F22B 13/04 122/235.12 |
| 2011/0017449 | A1 * | 1/2011 | Berruti | E21B 36/025 166/272.3 |
| 2014/0262257 | A1 * | 9/2014 | Costanzo | F22G 1/02 166/272.3 |
| 2014/0305645 | A1 * | 10/2014 | MacAdam | F22B 1/18 166/303 |
| 2017/0130953 | A1 * | 5/2017 | Barker | F22B 1/1815 |

* cited by examiner

*Primary Examiner* — Nathaniel Herzfeld

(74) *Attorney, Agent, or Firm* — Michael J. Seymour

(57) ABSTRACT

A boiler includes an upper steam drum, an optional intermediate drum, and a lower drum. Each drum is divided by an internal divider into a clean section and a concentrated section. Downcomers connect the upper steam drum to the lower drum, and tubes are connected to convey a heated steam-water mixture from the lower drum into the upper steam drum (through the optional intermediate drum, if provided). An optional superheater has an input terminal connected to receive steam from the clean section of the upper steam drum. An attemperator may be provided to attemperate superheated steam output from an output terminal of the superheater, and the attemperation fluid may optionally be provided from the concentrated side of the upper steam drum.

23 Claims, 12 Drawing Sheets

NATURAL CIRCULATION MULTI-CIRCULATION PACKAGE BOILER WITH SUPERHEAT FOR STEAM ASSISTED GRAVITY DRAINAGE (SAGD) PROCESS INCLUDING SUPERHEAT

BACKGROUND

The present disclosure relates generally to boiler design and, in particular, to boilers useful in Steam Assisted Gravity Drainage ("SAGD") processes for operating with sub-ASME quality feedwater such as oil sands, heavy oil and bitumen recovery, and other industrial boiler applications such as pulp and paper processing and waste heat boilers that receive heat from a combustion gas turbine and so forth.

The recovery of bitumen and subsequent processing into synthetic crude from the oil sands in northern Alberta, Canada continues to expand. Approximately 80% of known reserves are buried too deep to use conventional surface mining techniques. These deeper reserves are recovered using in-situ techniques such as SAGD in which steam is injected via horizontal wells into the oil sands deposit (injection well). This heats the bitumen, which flows by gravity to another horizontal well lower in the deposit (production well), where the mixture of bitumen and water is taken to the surface. After the water is separated from the bitumen, the water is treated and then returned to the boiler for reheating and re-injection into the well.

Re-use of the water resource is a key factor for both conservation and environmental regulations. Even after treatment, however, the boiler feedwater can still contain volatile and non-volatile organic components as well as high levels of silica. Some systems and processes for addressing this issue include those in U.S. Pat. No. 7,533,632 and U.S. Patent Publ. U.S. 2017-0130953 A1. Additionally, for SAGD processes employing deeper horizontal wells, it can be difficult to deliver steam at sufficiently high pressure to the deeper well. Other systems and processes for addressing this issue would be desirable.

BRIEF DESCRIPTION

The present disclosure relates to boilers and their use in steam assisted gravity drainage (SAGD) processes. The boilers typically include a steam drum, an intermediate drum, and a lower drum (or mud drum). Each of the three drums contains an internal divider that divides the drum into a clean section and a concentrated section (or dirty section). The intermediate drum and the lower drum also include a channel that runs adjacent a sidewall of the drum from the internal divider to a distal end of the concentrated section, with the channel being fluidly connected to the clean section of the drum. High-quality feedwater runs through the clean sections of the drums, while relatively low-quality feedwater runs through the concentrated sections of the drums. The presence of the channels in the concentrated section of the intermediate drum and the lower drum permit low-quality feedwater tubes and high-quality feedwater tubes to be arranged in parallel rows next to each other, as will be explained herein.

Disclosed in various embodiments are boilers comprising: an intermediate drum, a lower drum, a furnace, a clean section steam generating bank, and a concentrated section steam generating bank. The intermediate drum comprises (A) an internal divider that divides the intermediate drum into a clean section and a concentrated section, and (B) a channel that is fluidly connected to the clean section, the channel running adjacent a sidewall of the intermediate drum through the internal divider to a distal end of the concentrated section. The lower drum comprises (A) an internal divider that divides the intermediate drum into a clean section and a concentrated section, and (B) a channel that is fluidly connected to the clean section, the channel running adjacent a sidewall of the intermediate drum through the internal divider to a distal end of the concentrated section. The furnace is defined by a furnace sidewall and a baffle wall. Tubes in a front portion of the furnace sidewall and a front portion of the baffle wall extend between the intermediate drum channel and the lower drum channel. The clean section steam generating bank extends between the intermediate drum clean section and the lower drum clean section. Finally, the concentrated section steam generating bank extends between the intermediate drum concentrated section and the lower drum concentrated section.

In a gas flow path, the clean section steam generating bank may be downstream of the furnace and upstream of the concentrated section steam generating bank.

The clean section steam generating bank and the concentrated section steam generating bank may be located on an opposite side of the baffle wall from the furnace.

The concentrated section steam generating bank may be located so that heat flux on the concentrated section steam generating bank is less than 20,000 BTU/hr-ft$^2$ or 10,000 BTU/hr-ft$^2$, or at an acceptable rate, which may depend upon the application and/or water conditions.

The furnace, the clean section steam generating bank, and the concentrated section steam generating bank may operate by natural circulation, and do not contain mechanical pumps.

The ratio of a cross-sectional area of the intermediate drum channel to a cross-sectional area of the intermediate drum (inner diameter) may be from about 0.1 to about 0.2. The ratio of a cross-sectional area of the lower drum channel to a cross-sectional area of the lower drum (inner diameter) may be from about 0.1 to about 0.3.

The boiler may further comprise a steam drum comprising an internal divider that divides the steam drum into a clean section and a concentrated section, the internal divider including a veer that fluidly connects the clean section and the concentrated section. In some embodiments, at least one clean section riser extends between the intermediate drum clean section and the steam drum clean section; and at least one concentrated section riser extends between the intermediate drum concentrated section and the steam drum concentrated section. In additional embodiments, at least one clean section downcomer extends between the steam drum clean section and the lower drum clean section; and at least one concentrated section downcomer extends between the steam drum concentrated section and the lower drum concentrated section. The steam drum may be located above the intermediate drum, and the intermediate drum is located above the lower drum. The steam drum may comprise a scrubber and a perforated plate.

The boiler may further comprise a rear wall extending between the furnace sidewall and a boiler sidewall. The boiler may further comprise an economizer downstream of the concentrated section steam generating bank in the gas flow path. The boiler may further comprise burners located at a front end of the boiler, and adapted to provide a heated gas to the furnace. Multi-lead ribbed (MLR) tubing may be used in the furnace sidewall, the rear wall, the boiler sidewall, the steam generating bank, and/or the baffle wall, or in any combination thereof.

In other embodiments, which are generally combinable with the foregoing embodiments, a boiler includes an upper steam drum, an optional intermediate drum, and a lower drum. Downcomers connect the upper steam drum to the lower drum, and tubes are connected to flow a heated steam-water mixture from the lower drum into the upper steam drum (through the optional intermediate drum, if provided). A superheater has an input terminal connected to receive steam from the upper steam drum. Each steam drum is, in some embodiments, divided by an internal divider into a clean section and a concentrated section, and in such embodiments the input terminal of the superheater is preferably connected to receive steam from the clean section of the upper steam drum. An attemperator may be provided to attemperate superheated steam output from an output terminal of the superheater, and the attemperation fluid may optionally be provided from the concentrated side of the upper steam drum.

Also disclosed are methods for using a boiler, comprising: receiving a boiler as described above; and using steam generated by the boiler. The feedwater to the boiler may be fed to the clean section of the steam drum.

These and other non-limiting aspects of the present disclosure are discussed further herein.

BRIEF DESCRIPTION OF THE DRAWINGS

The following is a brief description of the drawings, which are presented for the purposes of illustrating embodiments disclosed herein and not for the purposes of limiting the same.

DETAILED DESCRIPTION

Figure 1:
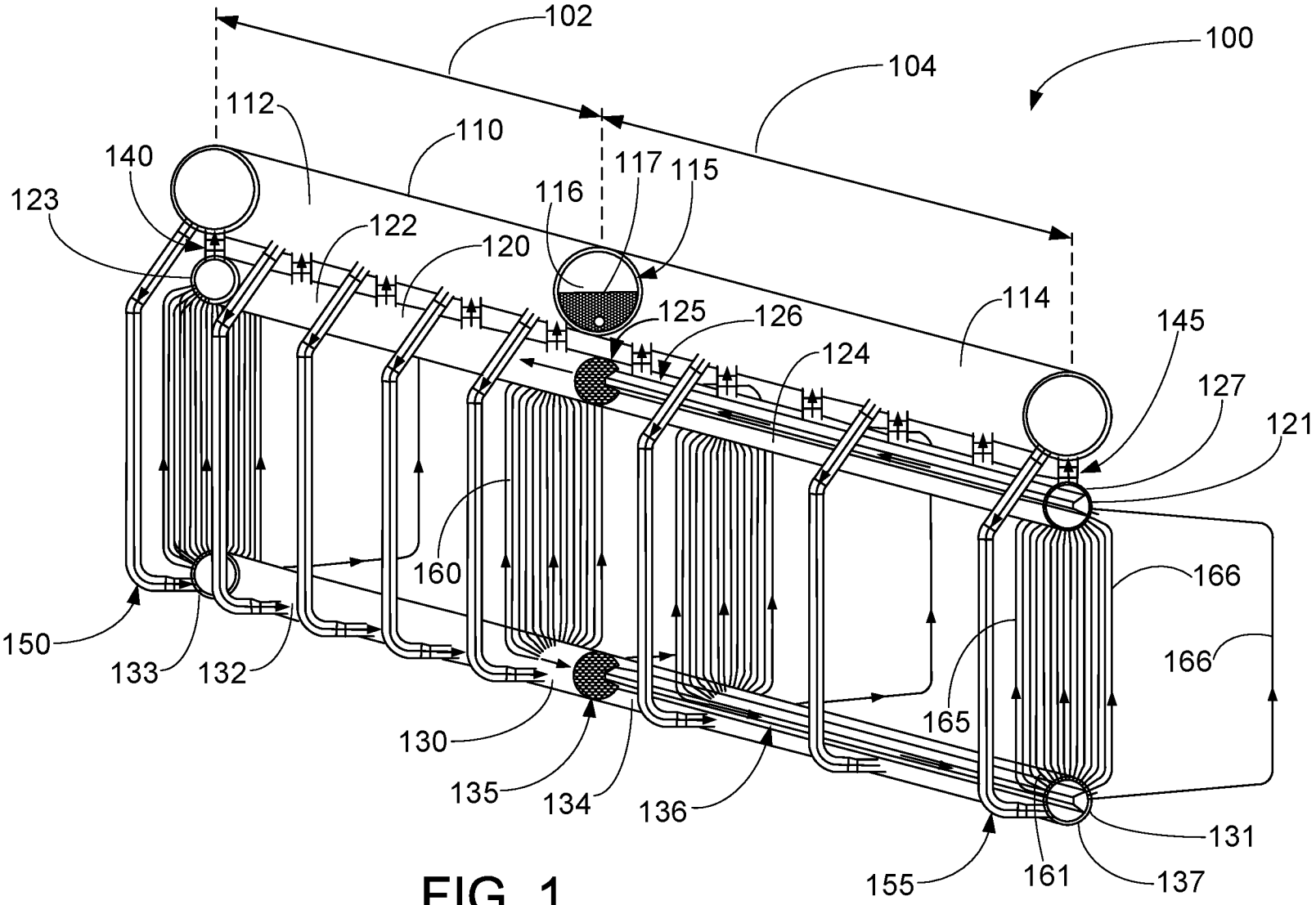
FIG. 1 is a first side perspective schematic diagram illustrating relevant parts of a boiler in accordance with some embodiments of the present disclosure.

A more complete understanding of the processes and apparatuses disclosed herein can be obtained by reference to the accompanying drawings. These figures are merely schematic representations based on convenience and the ease of demonstrating the existing art and/or the present development, and are, therefore, not intended to indicate relative size and dimensions of the assemblies or components thereof.

Although specific terms are used in the following description for the sake of clarity, these terms are intended to refer only to the particular structure of the embodiments selected for illustration in the drawings, and are not intended to define or limit the scope of the disclosure. In the drawings and the following description below, it is to be understood that like numeric designations refer to components of like function.

The singular forms "a," "an," and "the" include plural referents unless the context clearly dictates otherwise.

The term "comprising" is used herein as requiring the presence of the named components/steps and allowing the presence of other components/steps. The term "comprising" should be construed to include the term "consisting of", which allows the presence of only the named components/steps.

Numerical values should be understood to include numerical values which are the same when reduced to the same number of significant figures and numerical values which differ from the stated value by less than the experimental error of conventional measurement technique of the type described in the present application to determine the value.

All ranges disclosed herein are inclusive of the recited endpoint and independently combinable (for example, the range of "from 2 grams to 10 grams" is inclusive of the endpoints, 2 grams and 10 grams, and all the intermediate values).

A value modified by a term or terms, such as "about" and "substantially," may not be limited to the precise value specified. The modifier "about" should also be considered as disclosing the range defined by the absolute values of the two endpoints. For example, the expression "from about 2 to about 4" also discloses the range "from 2 to 4." The term "about" may refer to plus or minus 10% of the indicated number.

Some terms used herein are relative terms. For example, the terms "upper" and "lower" are relative to each other in location, i.e. an upper component is located at a higher elevation than a lower component. The terms "inlet" and "outlet" are relative to a fluid flowing through them with respect to a given structure, e.g. a fluid flows through the inlet into the structure and flows through the outlet out of the structure. The terms "upstream" and "downstream" are relative to the direction in which a fluid flows through various components, i.e. the fluids flow through an upstream component prior to flowing through a downstream component. It should be noted that in a loop, a first component can be described as being both upstream of and downstream of a second component.

The terms "horizontal" and "vertical" are used to indicate direction relative to an absolute reference, i.e. ground level. However, these terms should not be construed to require structures to be absolutely parallel or absolutely perpendicular to each other. For example, a first vertical structure and a second vertical structure are not necessarily parallel to each other. The terms "top" or "roof" and "bottom" or "floor" or "base" are used to refer to locations/surfaces where the top/roof is always higher than the bottom/floor/base relative to an absolute reference, i.e. the surface of the earth. The terms "upwards" and "downwards" are also relative to an absolute reference; upwards is always against the gravity of the earth.

As used herein, the front and rear are located along an x-axis; the left and right sides are located along a y-axis; and the roof and floor are located along a z-axis, wherein the three axes are perpendicular to each other.

A fluid at a temperature that is above its saturation temperature at a given pressure is considered to be "superheated." A superheated fluid can be cooled (i.e. transfer energy) without changing its phase. As used herein, the term "wet steam" refers to a saturated steam/water mixture.

Water may be referred to herein as "high-quality" or "low-quality". These two terms are relative to each other, and not to ASME standards. High-quality water has a lower concentration of dissolved contaminants compared to low-quality water.

To the extent that explanations of certain terminology or principles of the boiler and/or steam generator arts may be necessary to understand the present disclosure, the reader is referred to Steam/its generation and use, 42nd Edition, edited by G.L. Tomei, Copyright 2015, The Babcock & Wilcox Company, ISBN 978-0-9634570-2-8, the text of which is hereby incorporated by reference as though fully set forth herein.

As is known to those skilled in the art, heat transfer surfaces which convey steam-water mixtures are commonly referred to as evaporative boiler surfaces; and heat transfer surfaces which convey steam therethrough are commonly referred to as superheating (or reheating, depending upon the associated steam turbine configuration) surfaces. Regardless of the type of heating surface, the sizes of the tubes, their material, diameter, wall thickness, number, and arrangement are based upon temperature and pressure for service, according to applicable boiler design codes, such as the American Society of Mechanical Engineers (ASME) Boiler and Pressure Vessel Code, Section I, or other equivalent codes as required by law. ASME also identifies different standards of water quality based on the amount of various dissolved compounds and total dissolved solids (TDS) in the water.

As noted above, feedwater quality and boiler water quality are concerns, as the evaporation of steam results in contaminants in the boiler water becoming more concentrated. The concentrated contaminants can leave deposits in the various water pathways through the boiler, negatively impacting performance and degrading components. As a result of this concentration, the feedwater generally should be cleaner (i.e. lower permissible TDS) than the boiler water, so that boiler water quality limits can be maintained. In SAGD and similar process operations, the recovered water, after filtration, still contains relatively substantial amounts of contaminants.

In the present disclosure, the boiler includes multi-circulation technology for use in SAGD applications or other applications where feedwater contains relatively substantial amounts of contaminants. The feedwater is separated into two separate circulation loops within the boiler, referred to herein as (1) a "clean" section and (2) a "concentrated" or "dirty" section. Boiler water with the lowest concentration of dissolved solids circulates in the high heat flux zones of the boiler in the clean section. Boiler water with the highest concentration of dissolved solids circulates in the low heat flux zone of the boiler in the concentrated section. Deposition of contaminants in the low heat flux zone is less problematic due to the lower operating temperatures. The multi-circulation boiler design may be particularly useful for processes utilizing produced water (from the oil recovery stream) as a source of boiler feedwater.

Very generally, in the boiler, a heated gas flow path runs past water flowing along a water flow path (i.e. the clean and concentrated sections). The water in the water flow path captures heat energy from the gas flow path and forms a water/steam mixture, which is conveyed to a steam separator. The steam separator separates steam from water, and conveys the steam to an outlet for use for desired purposes.

FIG. 1 schematically illustrates a portion of a boiler 100 in accordance with some embodiments of the present disclosure. The boiler can operate by natural circulation, and does not need mechanical pumps to cause fluid flow. It is noted that this diagram does not show various tubes that would be present throughout much of the boiler for connecting the various components for natural circulation (i.e., without the need for mechanical circulation pumps) of feedwater, steam, and a water/steam mixture.

The boiler includes three drums: a steam drum 110, an intermediate drum 120, and a lower drum 130. The steam drum 110 is located above both the intermediate drum 120 and the lower drum 130. The intermediate drum 120 is located at a height below the steam drum 110 and above the lower drum 130. The lower drum 130 is located below both the steam drum 110 and the intermediate drum 120. In some embodiments, the centers of the drums are vertically aligned with each other.

In the steam drum 110, an internal divider 115 normal to the axis of the drum divides the interior volume of the steam drum into a clean section 112 and a concentrated section 114. It is noted that the clean section and the concentrated section do not have to take up the same volume or length of the steam drum. Solid portions of the internal divider 115 are illustrated in black. As can be seen here, the internal divider 115 is in the form of a veer that fluidly connects the clean section and the concentrated section. The veer is illustrated in the shape of a circle with a chord 116 at the top, and a circular segment removed along the top. This removed segment forms a top opening through which steam can travel between the clean section and the concentrated sections. A bottom opening 117 is also present along the bottom of the veer as well, through which heated water from the clean section can function as feedwater to the concentrated section. The bottom opening should be located below the water level in the steam drum, and can be in the form of an appropriately sized pipe. A natural head differential is present between the clean side and the concentrated side, so that water only flows from the clean side to the concentrated side.

The steam drum also includes one or more primary separators (not shown) which separate steam from water. The primary separator can be, for example, a perforated plate, or can operate by centrifugal force or radial acceleration to separate steam from water. One or more secondary scrubbers (not shown) can be used to increase steam separation, by providing a large surface that intercepts water droplets as steam flows sinuously between closely fitted plates. A resistor plate or perforated plate (not shown) may be located after the scrubbers to further separate water from steam. The resistor plate contains many small holes.

In the intermediate drum 120, an internal divider 125 normal to the axis of the drum divides the interior volume of the intermediate drum into a clean section 122 and a concentrated section 124. The clean section has a distal end 123, and the concentrated section has a distal end 127 (relative to the internal divider). It is noted that the clean section and the concentrated section do not have to take up the same volume or length of the intermediate drum. Solid portions of the internal divider 125 are illustrated in black. As shown here, the internal divider 125 is completely solid, except for an opening along its outer perimeter adjacent the sidewall 121 of the intermediate drum.

A channel 126 is also present in the intermediate drum, which runs from the opening of the internal divider to the distal end 127 of the concentrated section. The channel 126 is fluidly connected to the clean section, and is located adjacent the sidewall 121 of the intermediate drum. The channel is illustrated here as being formed from three solid walls, which separate the internal volume of the channel from the concentrated section. The channel can have a rectangular shape, or a trapezoidal shape, or could be cylindrical. In some embodiments, the channel 126 can occupy from about 30 degrees to about 90 degrees of the perimeter of the sidewall 121, or from about 30 degrees to about 60 degrees. In some embodiments, the ratio of the cross-sectional area of the channel to the cross-sectional area of the intermediate drum (inner diameter) is from about 0.1 to about 0.3, or in other words, the channel takes up about 10% to about 30% of the cross-sectional area of the intermediate drum. In some narrower embodiments, the ratio is from about 0.1 to about 0.2. The clean section 122 and the concentrated section 124 are completely separated from each other, so there is no mixing of fluids between the clean section 122 and the concentrated section 124 of the intermediate drum.

In the lower drum 130, an internal divider 135 normal to the axis of the drum divides the interior volume of the lower drum into a clean section 132 and a concentrated section 134. The clean section has a distal end 133, and the concentrated section has a distal end 137 (relative to the internal divider). It is noted that the clean section and the concentrated section do not have to take up the same volume or length of the lower drum. Solid portions of the internal divider 135 are illustrated in black. As shown here, the internal divider 135 is completely solid, except for an opening along its outer perimeter adjacent the sidewall 131 of the lower drum.

A channel 136 is also present in the lower drum, which runs from the opening of the internal divider to the distal end 137 of the concentrated section. The channel 136 is fluidly connected to the clean section, and is located adjacent the sidewall 131 of the lower drum. The channel is illustrated here as being formed from three solid walls, which separate the internal volume of the channel from the concentrated section. The channel can have a rectangular shape, or a trapezoidal shape, or could be cylindrical. In some embodiments, the channel 136 can occupy from about 30 degrees to about 90 degrees of the perimeter of the sidewall 131, or from about 30 degrees to about 60 degrees. In some embodiments, the ratio of the cross-sectional area of the channel to the cross-sectional area of the lower drum (inner diameter) is from about 0.1 to about 0.3, or in other words, the channel takes up about 10% to about 30% of the cross-sectional area of the lower drum. In some narrower embodiments, the ratio is from about 0.1 to about 0.2. The clean section 132 and the concentrated section 134 are completely separated from each other, so there is no mixing of fluids between the clean section 132 and the concentrated section 134 of the lower drum.

It should be noted that the steam drum 110, the intermediate drum 120, and the lower drum 130 are oriented so their clean sections 112, 122, 132 and their concentrated sections 114, 124, 134 are vertically aligned with each other. This orientation permits tubes to extend vertically between the three drums while maintaining separate circulation circuits. Also, the intermediate drum 120 and the lower drum 130 are oriented so their channels 126, 136 are on the same side of the boiler. This orientation permits tubes to extend between the two channels.

As further seen in FIG. 1, a plurality of clean risers 140 connect the clean section 122 of the intermediate drum 120 to the clean section 112 of the steam drum 110. A plurality of concentrated risers 145 connect the concentrated section 124 of the intermediate drum 120 to the concentrated section 114 of the steam drum 110. A plurality of clean downcomers 150 run between the clean section 112 of the steam drum 110 and the clean section 132 of the lower drum 130. A plurality of concentrated downcomers 155 run between the concentrated section 114 of the steam drum 110 and the concentrated section 134 of the lower drum 130.

At least one clean section steam generating bank 160 extends between the clean section 122 of the intermediate drum 120 and the clean section 132 of the lower drum 130. At least one concentrated section steam generating bank 165 extends between the concentrated section 124 of the intermediate drum 120 and the concentrated section 134 of the lower drum 130. Each steam generating bank (clean or concentrated) is made up of several rows and columns of tubes which are arranged with spaces between tubes so that heated gas can flow around the tubes and transfer heat energy into water flowing inside the tubes. No membrane is present between tubes in the steam generating bank(s).

The boiler 110 may thus be considered to be divided into a clean section 102 and a concentrated or dirty section 104. Relatively high-quality water flows through the clean section, and relatively low-quality water flows through the concentrated section. (Please note that "low" and "high" quality water are relative to each other, and not to ASME standards.) The clean section 102 of the boiler includes the clean section 112 of the steam drum 110; the clean section 122 of the intermediate drum 120; the clean section 132 of the lower drum 130; the clean risers 140; the clean downcomers 150; and the clean section steam generating bank(s) 160. The concentrated section 104 of the boiler includes the concentrated section 114 of the steam drum 110; the concentrated section 124 of the intermediate drum 120; the concentrated section 134 of the lower drum 130; the concentrated risers 145; the concentrated downcomers 155; and the concentrated section steam generating bank(s) 165. The clean section 102 and the concentrated section 104 are fluidly connected through the steam drum 110, where the bottom opening 117 permits water to be fed from the steam drum clean section 112 into the steam drum concentrated section 114, and through the top opening 116 above the internal divider 115 through which steam can travel.

The clean and concentrated section steam generating banks 160, 165 are formed from a series of tubes extending between the intermediate drum 120 and the lower drum 130. It is noted that due to the presence of the channels 126, 136 along one side of these drums, it is possible for tubes in the concentrated section (i.e. with dirty water flowing through them) to be placed next to tubes in the clean section (i.e. with clean water flowing through them) in the lateral direction. Referring still to FIG. 1, tubes 161 are fluidly connected to the concentrated sections 124, 134 of the intermediate and lower drums 120, 130. Tubes 166 are fluidly connected to the channels 126, 136 of the intermediate and lower drums 120, 130. These tubes 161, 166 are in a common plane (going left-to-right across the page), but receive water of different quality. This permits flexible boiler design and exposure to different heat fluxes, as will be explained further herein.

FIG. 1 also illustrates the water flow path through the boiler. Feedwater enters the clean section 112 of the steam drum 110. The water from the clean section 112 flows through clean downcomers 150 down to the clean section 132 of the lower drum 130. The water from the concentrated section 114 flows through concentrated downcomers 155 down to the concentrated section 134 of the lower drum 130. Water from the clean section 112 can also flow into the concentrated section 114 of the steam drum through opening 117, acting as feedwater for the concentrated section 104 of the boiler. The clean section 132 feeds the clean section steam generating bank(s) 160, and the concentrated section 134 feeds the concentrated section steam generating bank(s) 165. In the tubes of these steam generating banks, water absorbs heat energy from the heated (flue) gas and becomes a steam/water mixture. The steam/water mixture flows upwards into the clean section 122 and the concentrated section 124 of the intermediate drum 120. The steam/water mixture passes through clean risers 140 and concentrated risers 145 from the intermediate drum 120 into the clean section 112 and the concentrated section 114 of the steam drum 110. In the steam drum, the mixture is separated into water and wet steam (i.e., saturated steam).

Figure 2:
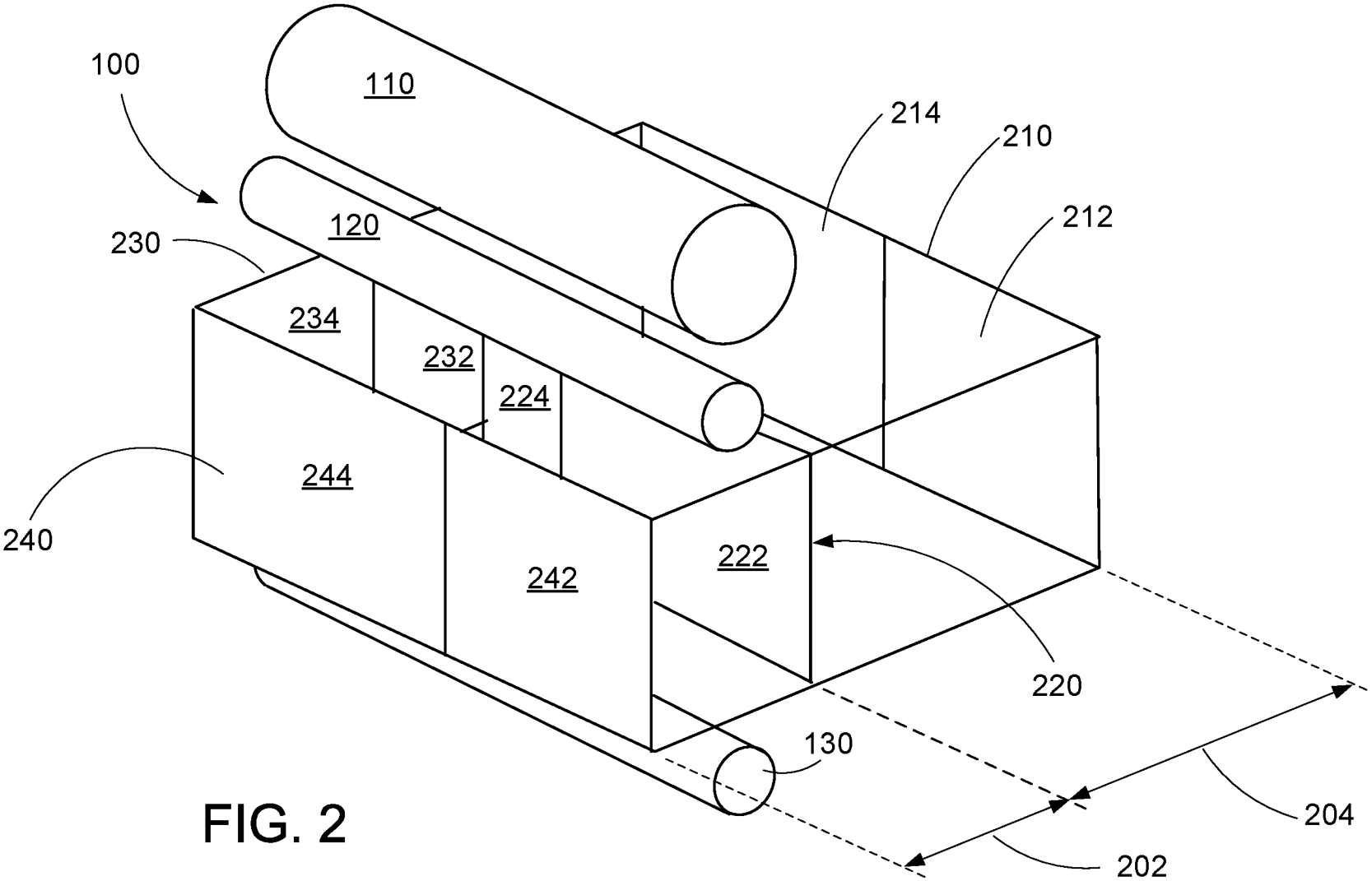
FIG. 2 is a second side perspective schematic diagram illustrating the various walls of the boiler of FIG. 1. For clarity, the individual tubes, downcomers, and risers are not shown in this diagram.

FIG. 2 is a perspective view of the boiler 100, identifying various walls of the boiler and their relationship to each other. For clarity, the tubes of the steam generating banks, and the tubes that make up the roof and floor of the boiler are not shown.

The boiler 100 has several walls. The walls are formed from the tubes that run between the intermediate drum 120 and the lower drum 130. A membrane (not illustrated) is present between adjacent tubes in the walls (note, not all tubes are part of the walls). The membrane significantly reduces the ability of gas to flow from one side of the tube to the other side, forming membrane tube panels that act as a wall and can direct the gas flow, i.e. each membrane tube panel is gas-tight. As is known in the art, water will run through the interior of the tubes and absorb heat energy from heated gas passing along the exterior of the tubes.

The boiler 100 is divided into a boiler section 202 and a furnace section 204. The furnace section may be from about 60% to about 65% of the width of the boiler. The walls of the boiler 100 include a furnace sidewall 210 and a baffle wall 220, which are parallel to each other. The furnace sidewall 210 is divided into a front portion 212 and a rear portion 214. The baffle wall 220 is also divided into a front portion 222 and a rear portion 224. The boiler also includes a boiler sidewall 240, which is also parallel to the furnace sidewall and the baffle wall. The boiler wall 240 is also divided into a front portion 242 and a rear portion 244. It is noted that the front portions 212, 222, 242 of these three walls are aligned with each other.

The boiler also includes a rear wall 230, which can be divided into a furnace rear wall 232 and a boiler rear wall 234. The rear wall 230 extends between the furnace sidewall 210 and the boiler sidewall 240, or in other words is perpendicular to these sidewalls and the baffle wall as well. The furnace rear wall 232 meets the furnace sidewall 210 at one rear corner, and the boiler rear wall 234 meets the boiler sidewall 240 at the other rear corner. The baffle wall 220 does not extend to the rear wall 230.

The boiler section 202 of the boiler is located between the boiler sidewall 240 and the baffle wall 220. The furnace section 204 of the boiler is located between the baffle wall 220 and the furnace sidewall 210. The interior of the furnace section is hollow. Put another way, there are no water tubes or tube panels extending between the baffle wall and the furnace sidewall within the furnace section. The clean section and concentrated section steam generating banks (not shown) are present in the boiler section, or in other words are located on the opposite side of the baffle wall from the furnace. The steam drum 110, intermediate drum 120, and lower drum 130 are located above the boiler section 202.

Considering both FIG. 1 and FIG. 2 together now, all of the tubes of the furnace sidewall 210 and all of the tubes of the baffle wall 220 are fed with water from the clean section of the boiler. In particular, the tubes that make up the front portion 212 of the furnace sidewall and the tubes that make up the front portion 222 of the baffle wall are connected to the channels 126, 136 of the intermediate drum 120 and the lower drum 130. Put another way, tubes 166 of FIG. 1 form the front portion 212 of the furnace sidewall and the front portion 222 of the baffle wall in FIG. 2. The tubes that make up the front portion 242 of the boiler sidewall are connected to the concentrated sections 124, 134 of the intermediate drum and the lower drum.

The tubes that make up the rear portions 214, 224, 244 of the furnace sidewall, baffle wall, and boiler sidewall are connected to the clean sections 122, 132 of the intermediate drum and the lower drum (i.e. they are not connected to the channels 126, 136). The tubes that make up the furnace rear wall 232 and the boiler rear wall 234 may also be connected to the clean sections 122, 132 of the intermediate drum and the lower drum (i.e. they are not connected to the channels 126, 136).

Although the roof and floor of the boiler are not shown, an integrated configuration is used such that the floor, walls, and roof of the boiler are a single water circuit. This reduces the circuit length to reduce chances of internal deposits.

The preferred sloping of the roof and floor with respect to their respective drum is about 2 to 30 degrees to the horizontal, or more preferably about 2 to 5 degrees. The lower drum can be provided with access to one or more drains, for draining and cleaning of the water circuit. The exterior of the membrane walls is desirably covered with insulation, e.g. about 3 to 6 inches minimum fiber board.

Minimum saturated velocities ensure that steam/water stratification, steam blanketing, and departure from nucleate boiling (DNB) do not occur, and that the possibility of solids deposition is minimized. Both steam blanketing and solids deposition can cause tube failure. Limits on saturated velocity are a function of tube orientation, tube location, internal tube surface geometry, heat flux, and fluid state.

Due to the shallow sloping tube geometry of several locations in the boiler the minimum saturated velocity requirements to avoid stratification can be greater than the predicted velocities in these locations. As a result, when minimum saturated velocity requirements are not met, multi-lead ribbed (MLR) tubing should be used for the tubes in the furnace sidewall 210, the rear wall 230, the boiler sidewall 240, the baffle wall 220, some or all areas of the clean steam generating bank(s) 160, and/or some or all areas of the concentrated steam generating bank(s) 165. It is noted that the MLR tubing is commonly used in the floor and roof portions of the water circuit including these walls and banks.

Figure 3:
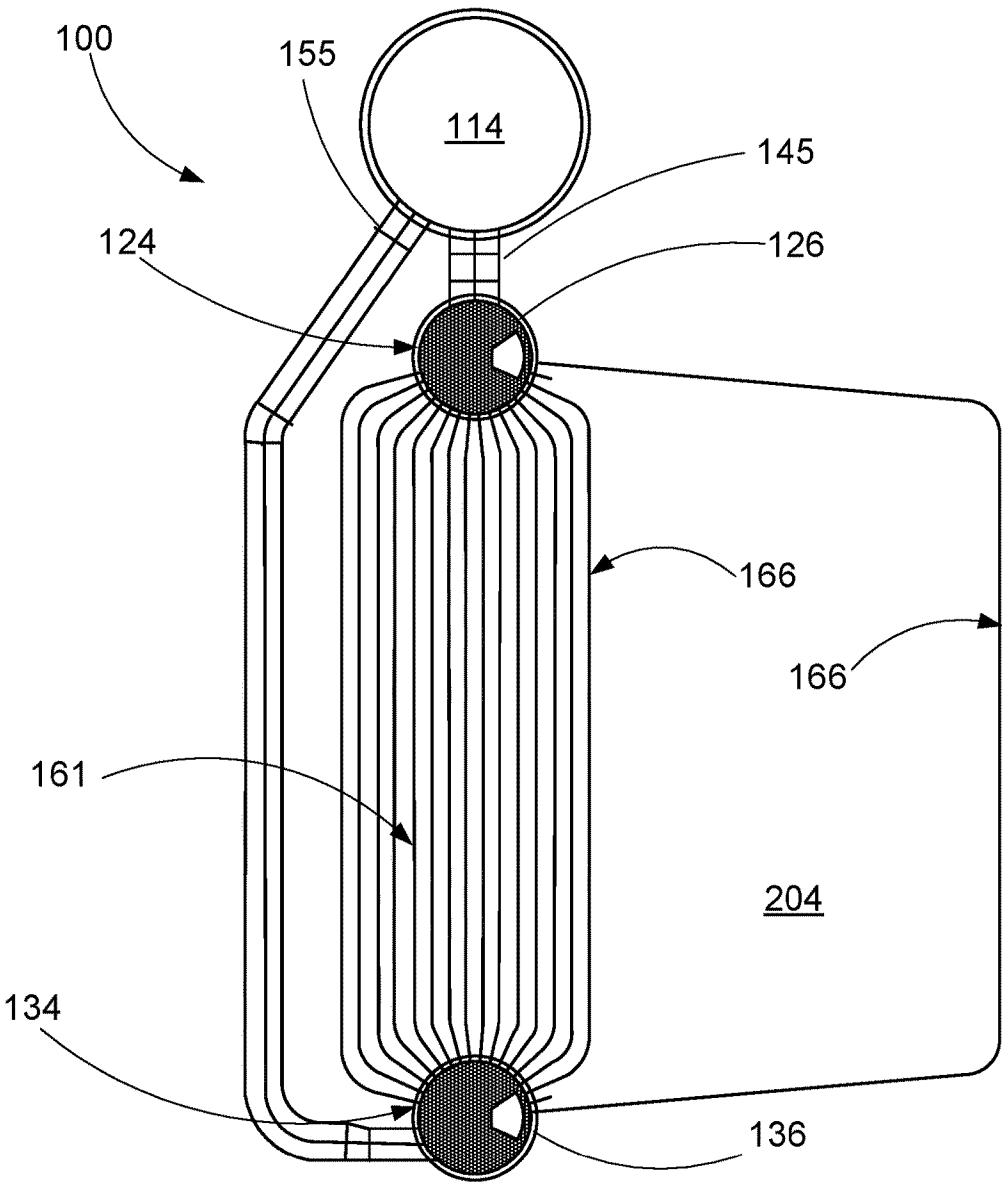
FIG. 3 is a front cross-sectional view of the steam generating bank along the concentrated sections of the steam drum, the intermediate drum, and the lower drum.

FIG. 3 is a front cross-sectional view of a steam generating bank along the concentrated sections 114, 124, 134 of the steam drum, the intermediate drum, and the lower drum. In this view, concentrated riser 145 and concentrated downcomer 155 are visible. The dark sections in the intermediate drum and the lower drum indicate the concentrated sections 124, 134, while the white section indicates the channels 126, 136 that are fluidly connected to the clean section. Tubes 161 are fluidly connected to the concentrated sections 124, 134. Referring back to FIG. 2, these tubes 161 will form the front portion 242 of the boiler sidewall and the concentrated section steam generating bank. Tubes 166, which are connected to the channels 126, 136, will form the front portions 212, 222 of the furnace sidewall and the baffle wall. These front portions 212, 222, 242 are aligned with each other across the width of the boiler. Returning now to FIG. 3, the furnace section 204 is indicated between tubes 166.

Figure 4:
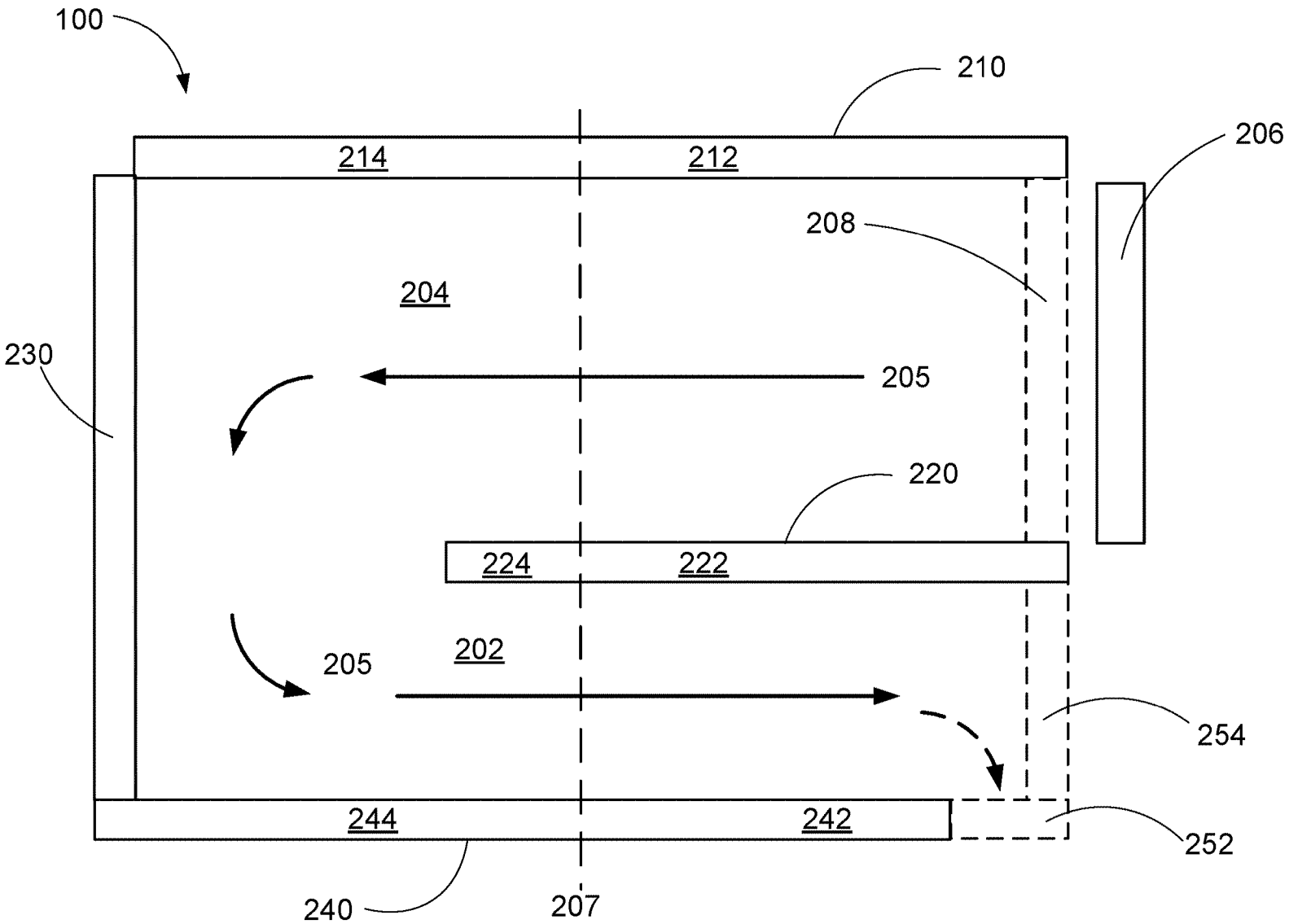
FIG. 4 is a plan view schematic diagram of the boiler of FIG. 1. For clarity, the individual tubes of the various walls and the steam generating banks are not shown in this diagram.

FIG. 4 is a plan view schematic diagram of the boiler 100, indicating the heated gas flow path and providing detail on some additional structures. The furnace sidewall 210, baffle wall 220, boiler sidewall 240, and rear wall 230 are all indicated here. Arrows 205 indicate the flow path of the heated gas which transfers heat energy to the water in the tubes of the various walls and the steam generating banks. The heated gas can be flue gas, or can be generated by front wall burners 206. The heated gas first travels through the furnace 204. The walls of the furnace are exposed to high heat fluxes so they are fed by high-quality feedwater (i.e. lower concentration of contaminants) from the clean section. At the rear wall 230, the heated gases turn 180° and then travel through the tubes in the boiler section 202.

The heated gases will first pass through the clean section steam generating bank(s), then pass through the concentrated section steam generating bank(s). The dashed line 207 indicates where the internal dividers 125, 135 would be located. The rear portions 214, 224, 244 of the boiler walls 210, 220, 240 to the left of the dashed line 207 are formed by tubes connected directly to the clean sections of the intermediate drum and the lower drum. The front portions 212, 222 of the boiler walls to the right of the dashed line 207 are formed by tubes connected to the channels 126, 136 that are fed with high-quality water. Put another way, the furnace sidewall 210, the baffle wall 220, and the rear wall 230 are fed entirely with high-quality water from the clean section. The front portion 242 of the boiler sidewall 240 is formed by tubes connected directly to the concentrated sections of the intermediate drum and the lower drum. The concentrated section steam generating bank(s) is located so that heat flux on the concentrated section steam generating bank is reduced to an acceptable rate. Depending on the boiler design, this location may change.

As the heated gas returns to the front of the boiler, the heated gas passes through an outlet screen, which is essentially a wall of tubes without membrane between the tubes, and exits the boiler. Reference numerals 252, 254 indicate portions of a wall which could be the outlet screen. For example, wall portion 252 may be the outlet screen, and wall portion 254 may be a membrane tube panel that acts as a boiler section frontwall. The heated gas can subsequently pass through an economizer to extract remaining heat energy and provide heated feedwater to the boiler. After passing through the economizer, the heated gas can also be sent to an air preheater and recycled as combustion air for the boiler.

In some applications, the boiler includes a burner wall 208 located in front of the burners 206, the burner wall being formed from membraned water-cooled tubes and having burner openings therein. In these applications, clean water flows through the water-cooled tubes that form burner wall 208. Due to location, the tubes of burner wall 208 would be fluidly connected to the channels 126, 136 of the intermediate drum 120 and the lower drum 130. These tubes in the burner wall can also be MLR tubing.

Figure 5:
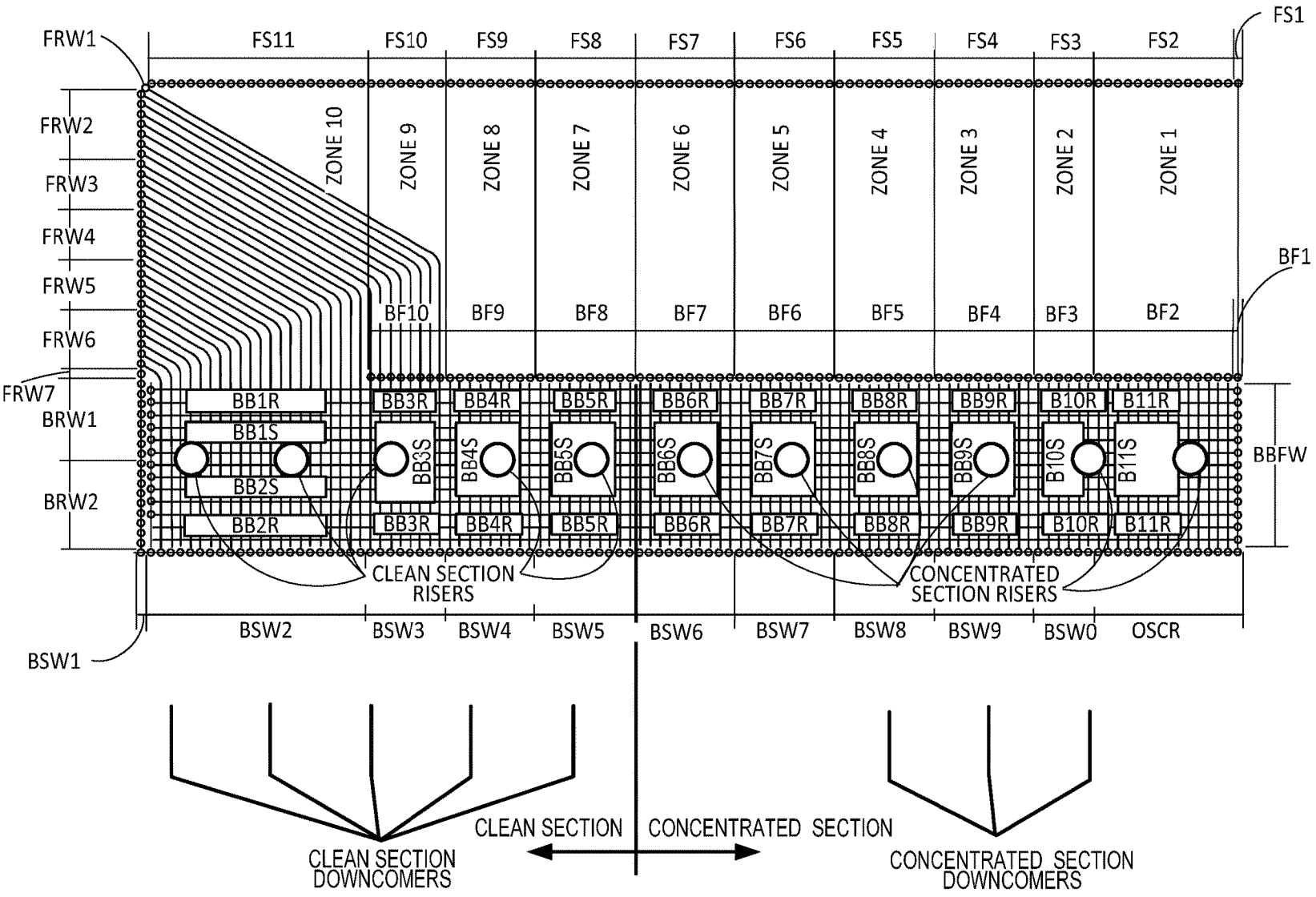
FIG. 5 is a plan view schematic diagram of the boiler of FIG. 1, illustrating the various circuits through which water/steam can pass through the boiler.
Figure 6:
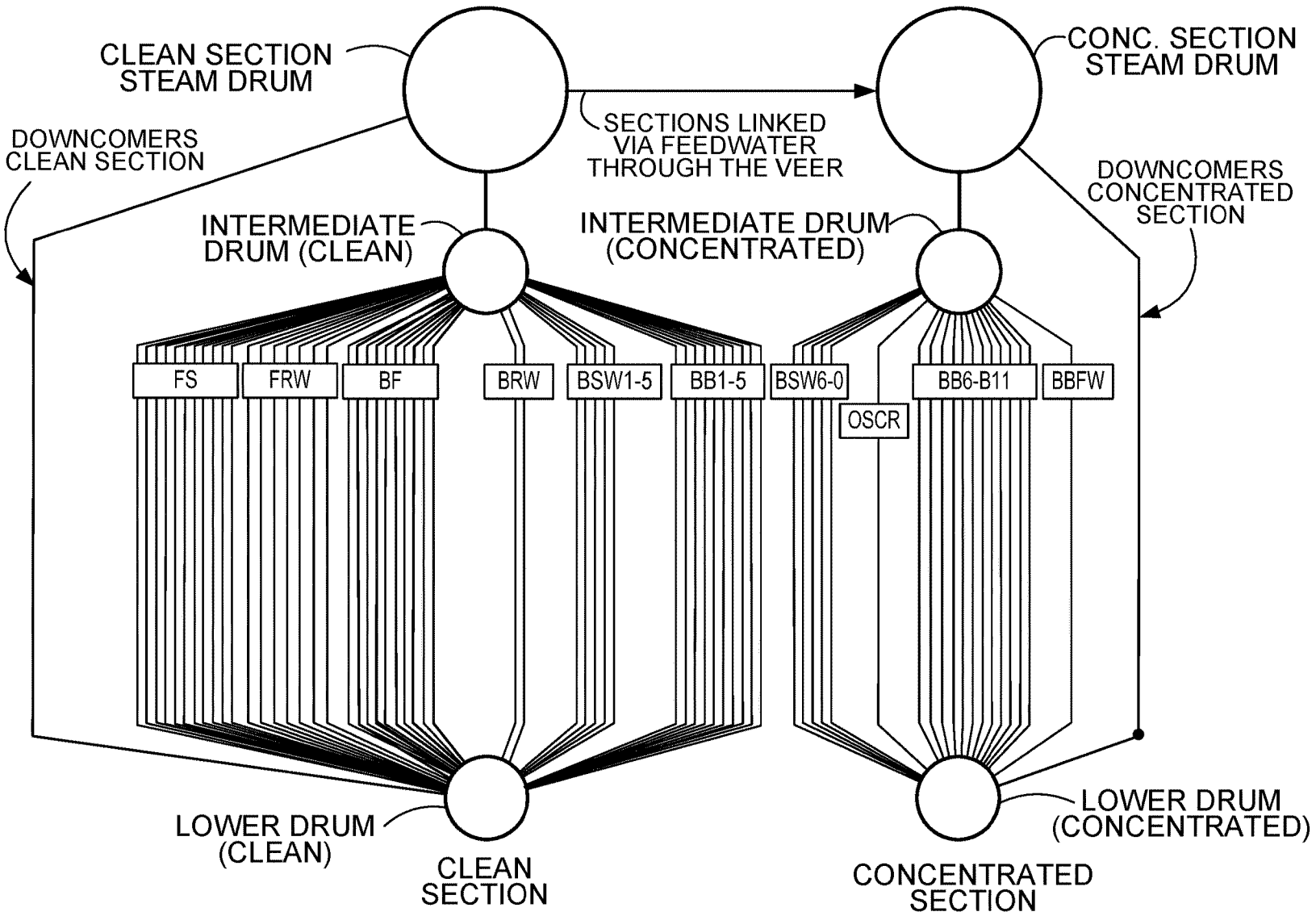
FIG. 6 is a schematic diagram of the boiler of FIG. 1, illustrating the various circuits through which water/steam can pass through the boiler.

FIG. 5 and FIG. 6 are circuit diagrams that provide more detail on how water/steam pass through the various walls and drums. FIG. 5 is a plan view of the boiler. FIG. 6 shows the connections between the walls and the three drums.

In FIG. 5, the abbreviation FS refers to the furnace sidewall. There are 11 zones in this wall, labeled FS1-FS11. The abbreviation BF refers to the baffle wall. There are 10 zones in this wall, labeled BF1-BF10. The abbreviation FRW refers to the furnace rear wall. There are 7 zones in this wall, labeled FRW1-FRW7. The abbreviation BRW refers to the boiler rear wall. There are 2 zones in this wall, labeled BRW1 and BRW2. The abbreviation BSW refers to the boiler sidewall. There are 10 zones in this wall, labeled BSW1-BSW0. The abbreviation OSCR refers to the outlet screen. The abbreviation BBFW refers to the boiler front wall. The 4-character abbreviation BR in the boiler section refers to locations where multi-lead ribbed (MLR) tubes could be used. The 4-character abbreviation BS in the boiler section refers to locations where smooth tubes could be used. In the boiler section, the circuits that begin with BB1* through BB5* are fed by the clean section of the lower drum. The circuits that begin with BB6* through B11* are fed by the concentrated section of the lower drum.

In FIG. 6, the various circuits between the clean sections of the steam drum, intermediate drum, and lower drum are illustrated on the left-hand side.

The various circuits between the concentrated sections of the steam drum, intermediate drum, and lower drum are illustrated on the right-hand side. The clean sections and concentrated sections are connected only through the steam drum.

As indicated here, the clean section feeds the furnace sidewall FS, furnace rear wall FRW, the baffle wall BF, the boiler rear wall BRW, the rear portion of the boiler sidewall BSW1-BSW5, and the clean section steam generating banks BB1* through BB5*.

As indicated here, the concentrated section feeds the front portion of the boiler side wall BSW6-BSW0, the outlet screen OSCR, the concentrated section steam generating banks BB6* through B11*, and the boiler front wall BBFW.

The boilers of the present disclosure thus include three drums: a steam drum at the highest elevation of the boiler, an intermediate drum that is located below the steam drum and is connected to the steam through large riser connections, and a lower drum or mud drum. Downcomer pipes run from the steam drum to the lower drum and provide subcooled or near saturation temperature water to the lower drum. Tubes that form the D-wall furnace of the boiler and the convection pass enclosure of the boiler, originate from the lower drum and the tubes are configured to enter the intermediate drum. The tubes of the furnace and convection pass absorb the heat generated by the fuel (typically natural gas or fuel oil) that is burned on the front side of the boiler's furnace. The hot gases travel through the furnace turn 180 degrees and flow through the convection pass to the boiler outlet. If the boiler is equipped with an economizer, the remaining heat is absorbed in the economizer. The fluid from the economizer is used to replace the steam that is generated in the boiler.

It will be appreciated that the use of multi-circulation technology will significantly reduce the potential for formation of internal tube deposits and fouling of the tubes and other components through the use of sub-ASME boiler feedwater associated with the use of mechanical vapor compression water treatment commonly used to treat produced water for use as boiler feedwater in SAGD facilities. The "dirty" water has sub-ASME quality water conditions that require lower heat input so that the deposition of solids, salts, and organics are minimized within the tubes and drums of the boiler. Such "dirty" water runs through the concentrated sections of the boiler, and do not encounter the high heat fluxes that "clean" water is exposed to.

The boilers of the present disclosure can generate over 400,000 lbs/hour of steam under appropriate conditions. The components of these boilers can also be separated to meet height, width, and weight limits for easier shipping while reducing the amount of assembly that must be done on-site.

As mentioned previously, in various embodiments are boilers comprising an intermediate drum, a lower drum, a furnace, a clean section steam generating bank, and a concentrated section steam generating bank. The illustrative embodiment of FIGS. 1-3 and 6 is a three-drum embodiment that further includes the steam drum 110.

Figure 7:
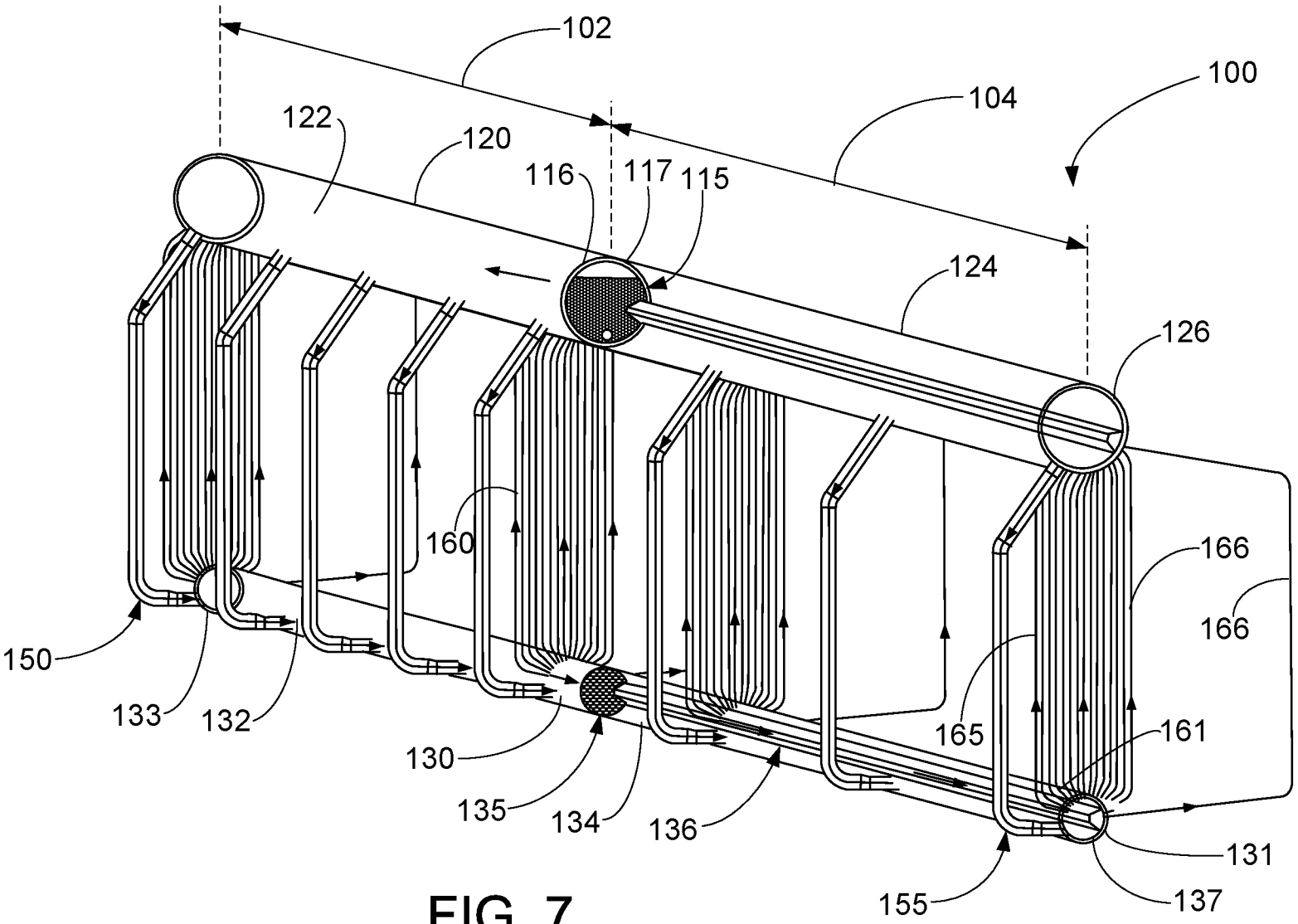
FIG. 7 is a side perspective schematic diagram illustrating relevant parts of a boiler in accordance with some embodiments of the present disclosure.

With reference now to FIG. 7, a two-drum embodiment is shown, in which the steam drum 110 of the three-drum embodiment is omitted. In this case, the intermediate drum 120 is the uppermost drum and serves as the steam drum insofar as the output clean steam is taken from the intermediate drum 120. In the embodiment of FIG. 7, reference numbers corresponding to reference numbers of FIG. 1 denote equivalent parts. The embodiment of FIG. 7 differs from the embodiment of FIG. 1 in that the steam drum 110 with its clean and concentrated sections 112, 114 is omitted, along with the risers 145. In effect, the intermediate drum 120 serves as the upper steam drum in the two-drum embodiment of FIG. 1, and therefore includes the internal divider 115 of the steam drum with its chord 116 and bottom opening 117 as described previously. The intermediate drum 120 of the two-drum embodiment retains its channel 126 which is again fluidly connected to the clean section 122, and is located adjacent the sidewall 121 of the intermediate drum 120. Because the intermediate drum 120 is serving as the steam drum in the two-drum embodiment of FIGS. 7-12, it is typically larger in diameter (relative to the lower drum 130) than the corresponding intermediate drum 120 of the three-drum embodiment of FIG. 1. Furthermore, in the two-drum embodiment of FIGS. 7-12, the clean downcomers 150 connect the clean section 122 of the intermediate drum 120 (rather than to the uppermost steam drum 110 as in the embodiment of FIG. 1) to the clean section 132 of the lower drum 130; and analogously the concentrated downcomers 155 connect the concentrated section 124 of the intermediate drum 120 to the concentrated section 134 of the lower drum 130.

The embodiments of FIGS. 1-7 do not include a superheater, and accordingly are saturated boilers in which the steam output from the steam drum 110 in the three-drum embodiment (FIG. 1), or from the steam drum 120 in the two-drum embodiment (FIG. 7), is saturated steam, rather than superheated steam. Superheated steam can be required for some applications of the SAGD process, the pulp/paper making process, or other applications. Some benefits of superheated steam over saturated steam include the ability to achieve a higher steam pressure, higher steam temperature, and complete elimination of any water phase in the superheated steam.

Figure 8:
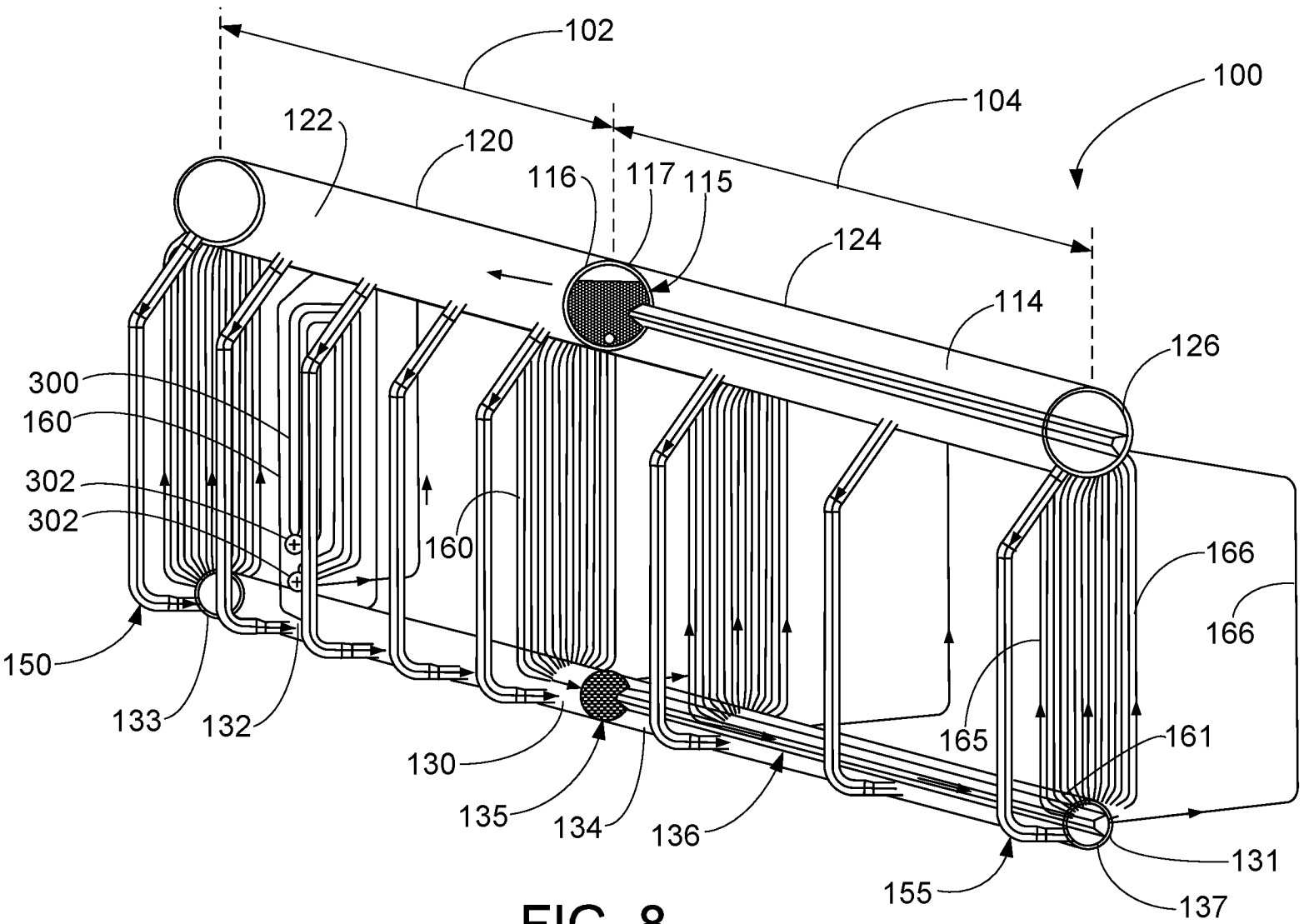
FIG. 8 is a side perspective schematic diagram illustrating relevant parts of the boiler of FIG. 7 modified to include a superheater.
Figure 9:
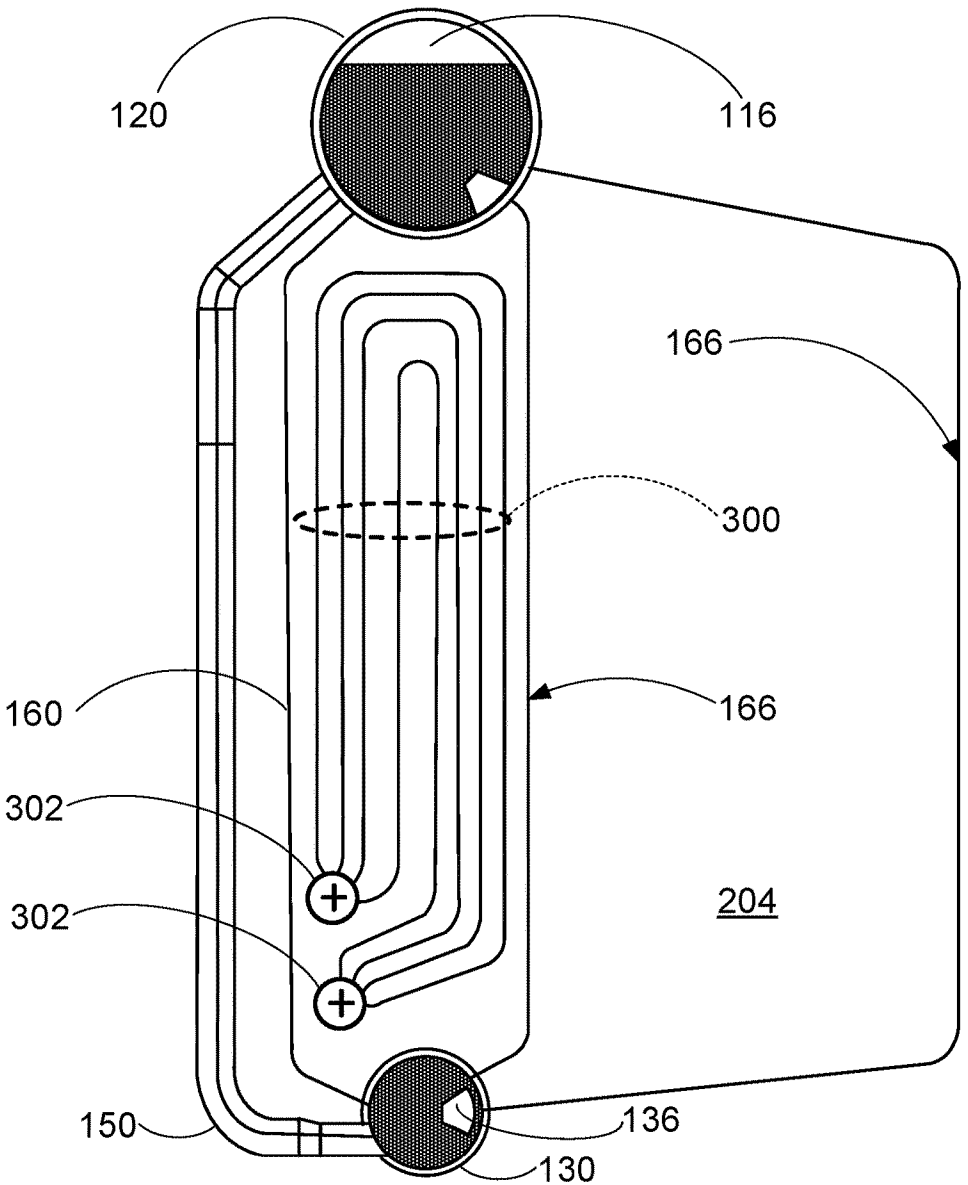
FIG. 9 is a front cross-sectional view of the superheater of FIG. 8.

With reference now to FIGS. 8 and 9, the two-drum boiler of FIG. 7 is modified as shown in FIG. 8 by adding a superheater 300, which is connected via steam input/output terminals 302 to be described later herein. In the embodiment of FIG. 8, the superheater 300 is disposed in the heated gas flow path in the clean section 102, effectively replacing some or all inner tubes (as shown; or, in other embodiments, the entire bank) of one clean section steam generating bank 160. In yet other embodiments, the superheater may be disposed along the heated gas flow path between two neighboring steam generating banks 160.

Figure 10:
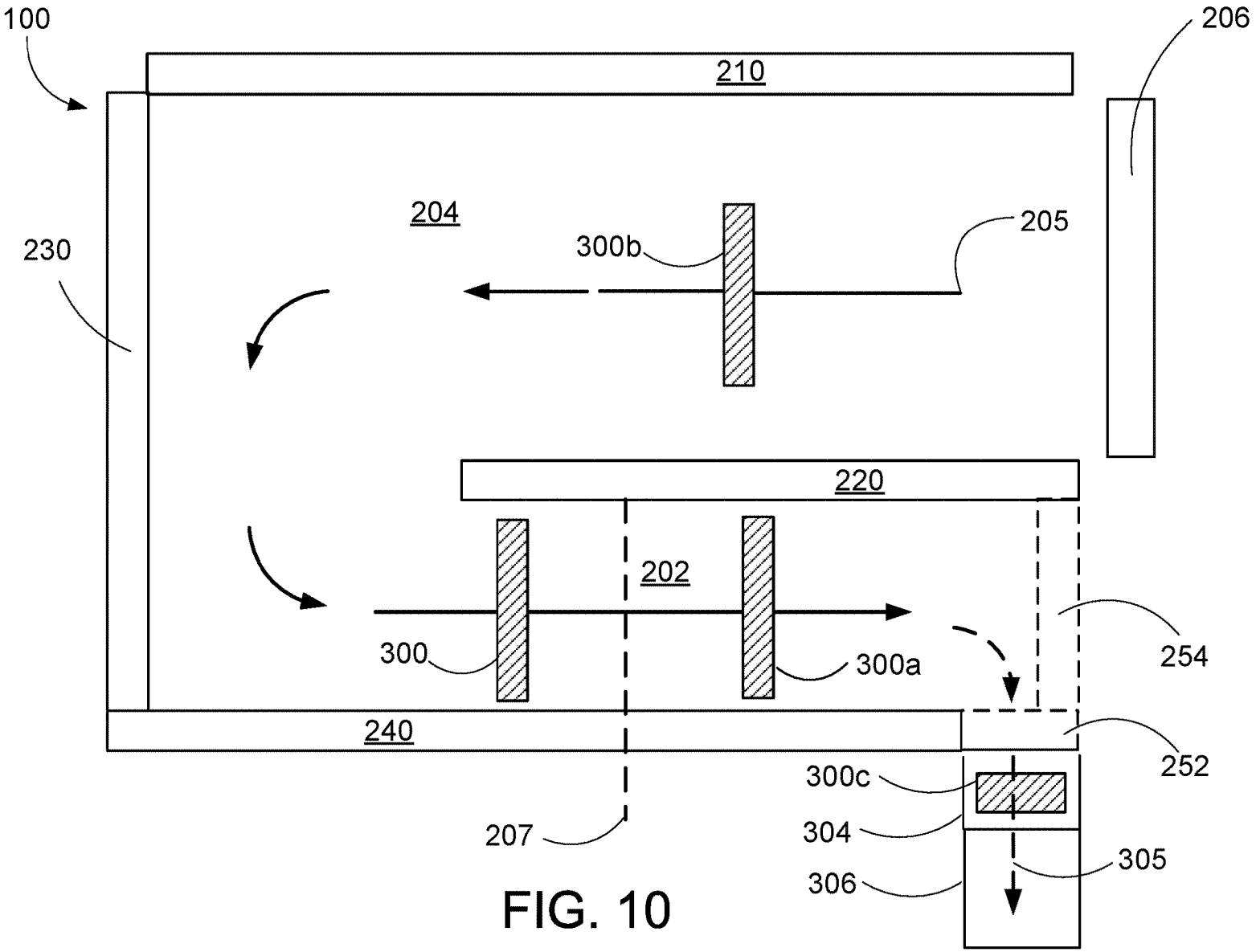
FIG. 10 is a plan view schematic diagram of the boiler of FIG. 1 or FIG. 7 illustrating some possible placements of an added superheater. For clarity, the individual tubes of the various walls and the steam generating banks are not shown in this diagram.

More generally, some suitable placements of the superheater are described with reference to FIG. 10 which corresponds to already-described FIG. 4 and which again presents the illustrative plan view schematic diagram of the boiler 100 indicating the heated gas flow path 205. FIG. 10 shows the placement of the illustrative superheater 300 in the clean section of the boiler (that is, in the boiler section 202 and upstream along the heated gas flow path 205 of the dashed line 207 indicating where the internal dividers 125, 135 are located; this placement corresponds to that of FIG. 8. More generally, as further depicted in FIG. 10, the superheater may be elsewhere located in the boiler 100, for example at a location 300*a* in the concentrated section of the boiler (that is, in the boiler section 202 and downstream along the heated gas flow path 205 of the dashed line 207 indicating where the internal dividers 125, 135 are located). As another example, the superheater may be located at a location 300*b* in the furnace section 204.

With continuing reference to FIG. 10, the location of the illustrative superheater 300, as well as the alternative locations 300*a*, 300*b*, are disposed within the boiler 100. As such, installation of a superheater at any of these locations may require substantial retrofitting of the boiler 100. In applications such as SAGD processing or pulp/paper processing, the boiler 100 may be located in a relatively remote locale, such as the oil sands in northern Alberta, Canada in the case of SAGD processing, or a lumber town in the Pacific Northwest of the United States in the case of a pulp/paper processing facility. This can make extensive retrofitting of an already-installed boiler difficult. For example, consider a SAGD processing site in which oil supplies from the shallower strata are becoming exhausted and it is decided to drill deeper horizontal wells into the oil sands to extract oil from deeper strata. In such a case, it may be difficult to achieve productive steam injection into the deeper injection wells using saturated steam. This can be addressed by retrofitting the existing saturated steam boiler with a superheater in order to provide superheated steam. However, adding the superheater 300 at its illustrated location, or adding a superheater at one of the alternative locations 300*a*, 300*b*, would require extensive modifications performed inside the boiler 100.

In an alternative embodiment, the superheater may be placed at an external location 300*c*. To do so, a superheater module housing 304 is provided, which contains the external location 300*c* of the external superheater and which defines a sealed conduit continuing the heated gas flow path 205 (this flow continuation is indicated as heated gas flow path 305 in FIG. 10). The superheater module housing 304 may be made of steam tube sheets, steel sheets, sheets of another material capable of withstanding the high temperature of the heated gas flow 305, a combination thereof, or so forth. In a suitable embodiment, superheater module housing 304 is designed as a connecting conduit extending between the outlet screen 252 of the boiler 100 and a downstream economizer 306. Advantageously, retrofitting the boiler with a superheater at the location 300*c* can be done with minimal or no modification of the boiler 100. For example, the modification may be limited to repositioning the economizer 306 further away from the outlet screen 252 and installing the superheater module housing 304 in the space freed by that relocation and providing suitable sealed connections between the outlet screen 252 and the superheater module housing 304 and between the superheater module housing 304 and the downstream economizer 306.

Figure 11:
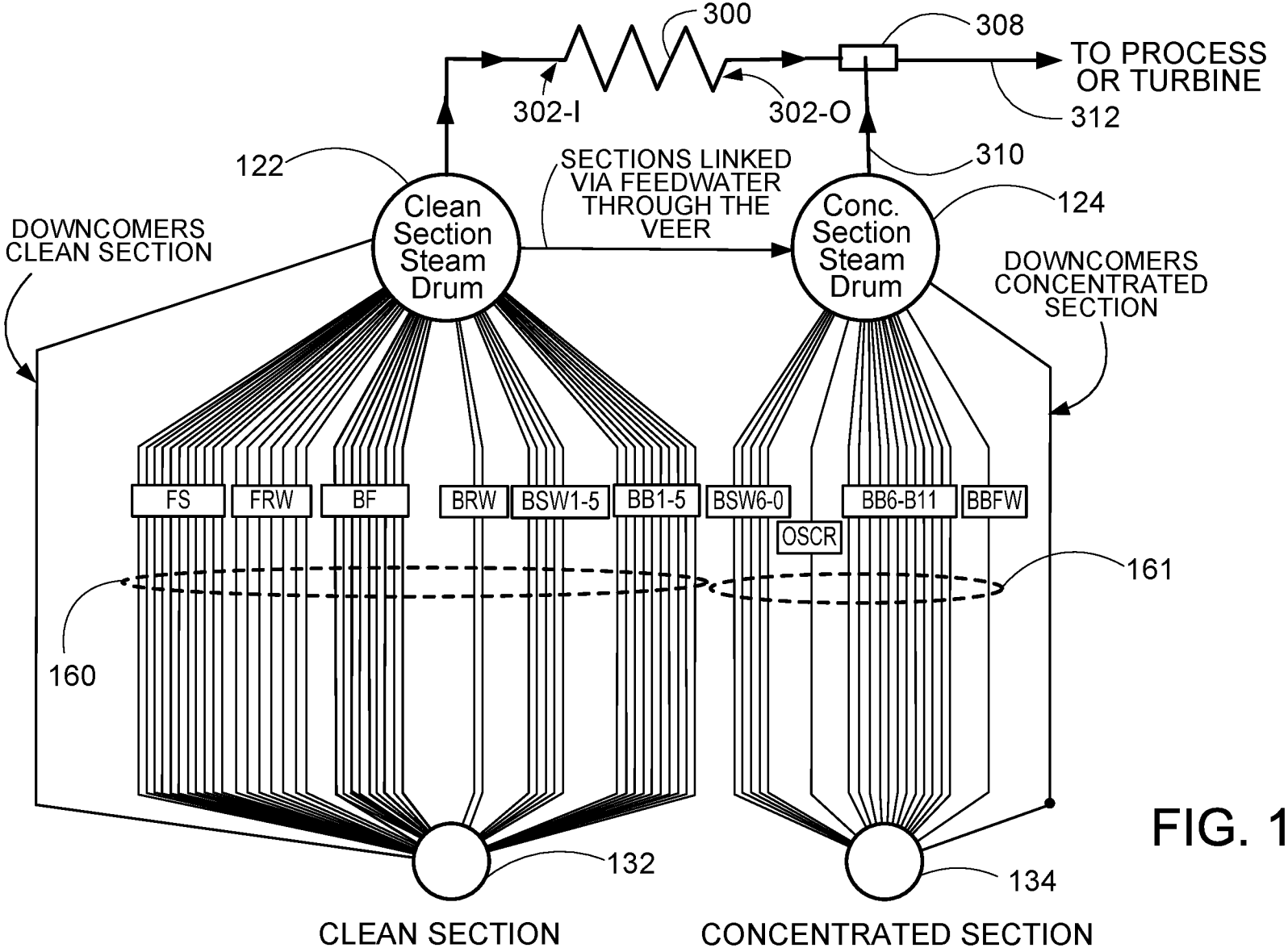
FIG. 11 presents a side-by-side front cross-sectional views of the steam generating bank along the clean section (left diagram) and concentrated section (right diagram) of the steam drum and the lower drum of the boiler of FIG. 8 further including a diagrammatic representation of a delivery circuit for delivering superheated steam from the superheater to a SAGD process or turbine or other application. In the cross-sectional views, interior details of the drums are omitted.

With returning reference to FIGS. 8 and 9 and with further reference to FIG. 11, the superheater 300 is connected via the steam input/output terminals 302. One illustrative connection circuit is shown in FIG. 11, which presents a side-by-side front cross-sectional views of: a steam generating bank 160 extending between the clean section 122 of the steam drum 120 (this is for the two-drum embodiment) and the clean section 132 of the lower drum (left diagram); and, a concentrated section extending between the concentrated section 124 of the steam drum 120 and the concentrated section 134 of the lower drum (right diagram). In the cross-sectional views, interior details of the drums are omitted. FIG. 11 further includes a diagrammatic representation of a delivery circuit for delivering superheated steam from the superheater 300 to a SAGD process or turbine or other application. In this illustrative circuit, clean steam is delivered to the superheater 300 from the clean section 122 of the steam drum 120 via an input terminal 302-I of the superheater 300, where the input terminal 302-I is one of the steam input/output terminals 302 of the superheater 300 as shown in FIGS. 8 and 9. The other one of the steam input/output terminals 302 of the superheater 300 serves as an output terminal 302-0 that outputs superheated steam. In the illustrative circuit of FIG. 11, the output terminal 302-0 of the superheater 300 is connected to an attemperator 308. The attemperator 308 receives input attemperation steam from the concentrated section 124 of the steam drum 120 (again, this is the two-drum embodiment) via a steam line 310. The output of the attemperator 308 feeds into a delivery steam pipe 312 that delivers superheated steam to the injection well of a SAGD process, or to the pulp/paper process, or to some other application.

For a saturated boiler with either a two-drum or three-drum design, the steam flow from the concentrated and clean sections are combined before being sent to the process application. The mixing can be done within the steam drum or external to the steam drum through a mixing tee or header. In the superheated design of FIG. 11, the steam from the clean section 122 of the steam drum is fed into the superheater 300 via inlet 302-I to be heated, and is then attemperated with saturated steam from the concentrated section 124 of the steam drum to reduce the steam temperature. Using this circuit, impurities or higher conductivity from the concentrated section 124 of the steam drum do not cause additional deposition within the tubes of the superheater 300, since the dirtier steam from the concentrated section 124 does not flow through the superheater. In a variant embodiment (not illustrated), if the conductivity of steam from the boiler is acceptable from both the clean and concentrated sections of the steam drum, then mixing of the steam from both sections could be done as another option. Yet another contemplated variant (not shown) could use the clean steam from the clean section 122 and the concentrated steam from the concentrated section 124 for two different application processes that are separate from each other (wherein in this case the process driven by the concentrated steam is expected to be more tolerant of the impurities in the concentrated steam). In still yet another contemplated variant (not shown), steam temperature reduction through attemperation could also be accomplished using feedwater instead of steam. (In other words, in this embodiment FIG. 11 would be modified by connecting the pipe 310 to deliver feedwater to the attemperator 308).

Figure 12:
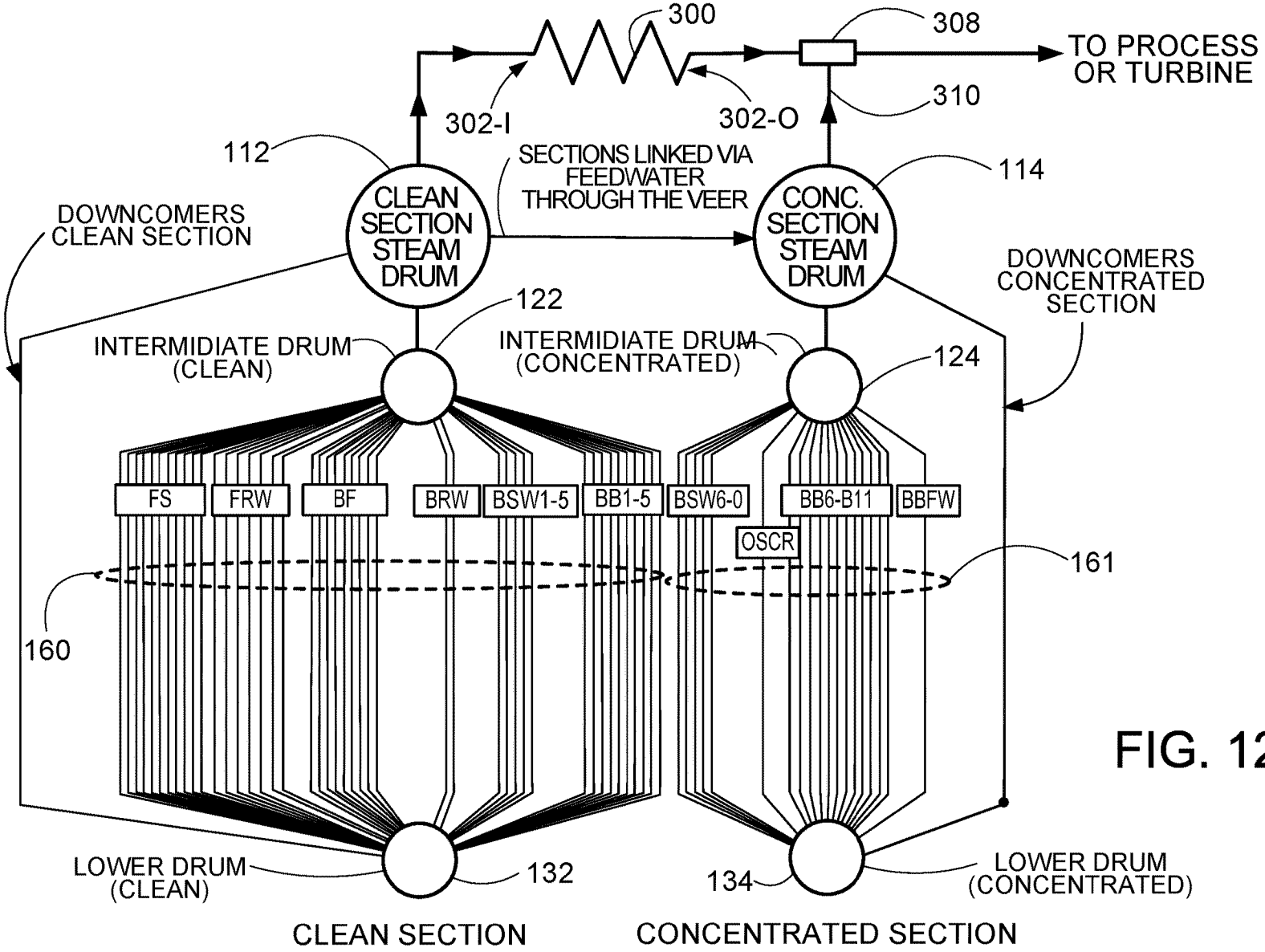
FIG. 12 presents a side-by-side front cross-sectional views of the steam generating bank along the clean section (left diagram) and concentrated section (right diagram) of the steam drum, the intermediate drum, and the lower drum of the boiler of FIG. 1 further including a diagrammatic representation of a delivery circuit for delivering superheated steam from an added superheater to a SAGD process or turbine or other application. In the cross-sectional views, interior details of the drums are omitted

With reference to FIG. 12, a corresponding embodiment employing the three-drum boiler of FIGS. 1-3 and 6 is shown. In this superheater circuit, the input terminal 302-I of the superheater 300 receives clean steam from the clean section 112 of the uppermost steam drum 110, while the pipe 310 receives concentrated steam for delivery to the attemperator 308 from the concentrated section 114 of the uppermost steam drum 110. The attemperated superheated steam is delivered to the injection well, the pulp/paper process, a turbine, or other steam-driven component via the delivery steam pipe 312 as in the embodiment of FIG. 11.

In general, the superheater is connected with the upper steam drum (that is, the upper steam drum 120 in the two-drum embodiment as shown in FIG. 11, or the upper steam drum 110 in the three-drum embodiment as shown in FIG. 12). The superheater is preferably not connected with the lower drum 130 and, in the three-drum embodiment, the superheater is preferably not connected with the intermediate drum 120. This ensures that the superheater receives saturated steam which is pure stream. In the illustrative embodiments which employ the internal divider 115 in the upper stream drum 110 (three drum embodiment) or which employ the internal divider 115 in the upper steam drum 120 (two drum embodiment), the superheater is preferably connected to receive steam only from the clean section 112 (three drum embodiment) or only from the clean section 122 (two drum embodiment). This ensures that clean steam (rather than concentrated steam) flows through the superheater.

Optionally, the output of the superheater is connected with an attemperator to provide temperature control of the superheated steam sent to the delivery steam pipe. In general, the attemperator receives an attemperation fluid (e.g. water, saturated steam, or a water/steam mixture) and injects the attemperation fluid into the superheated steam output from the output terminal of the superheater. As the attemperation fluid is at a lower temperature than the superheated steam, injection of the attemperation fluid into the superheated steam flow operates to cool the superheated steam. The attemperator is typically controllable via an actuated valve (e.g. a pneumatically actuated valve, a hydraulically actuated valve, and electromechanically actuated valve, or so forth) to control the flow rate of attemperation fluid into the superheated steam flow, thereby providing for temperature control. As illustrated in FIGS. 11 and 12, In the illustrative embodiments which employ the internal divider 115 in the upper stream drum 110 (three drum embodiment) or which employ the internal divider 115 in the upper steam drum 120 (two drum embodiment), the attemperator 308 may suitably receive concentrated steam via pipe 310 to serve as the attemperation fluid. As the attemperation fluid does not flow through the superheater 300, impurities in the concentrated steam are less problematic compared with flowing this stream through the superheater. In other embodiments the attemperation fluid may be feedwater or some other reliable and suitably pure attemperation fluid source.

The illustrative embodiments employ a single superheater 300. However, it is contemplated to employ two or more superheaters connected in series, e.g. a first superheater whose output terminal feeds into the input terminal of a second superheater. In this case, the two or more series-connected superheaters can be treated as a single superheater for the purposes of the circuit depicted in FIG. 11 or FIG. 12 (e.g., in the two-superheater example above, the input terminal of the first superheater serves as the input terminal 302-I of FIG. 11 or FIG. 12 while the output terminal of the second superheater serves as the output terminal 302-0 of FIG. 11 or FIG. 12. An advantage of such a series arrangement of two or more superheaters is that it allows for spatial distribution over the boiler. For example, considering again FIG. 10, the first superheater could be at the location 300*b* and the second superheater could be at the location 300*a*.

The present disclosure has been described with reference to exemplary embodiments. Modifications and alterations will occur to others upon reading and understanding the preceding detailed description. It is intended that the present disclosure be construed as including all such modifications and alterations insofar as they come within the scope of the appended claims or the equivalents thereof.

The invention claimed is:

1. A boiler comprising:

an upper steam drum having an internal divider which divides the upper steam drum into a clean section and a concentrated section;

a lower drum having an internal divider which divides the lower drum into a clean section and a concentrated section;

clean downcomers connecting the clean section of the upper steam drum to the clean section of the lower drum;

concentrated downcomers connecting the concentrated section of the upper steam drum to the concentrated section of the lower drum;

steam-water tubes connected to convey a steam-water mixture from the lower drum into the upper steam drum;

a superheater having an input terminal connected to receive steam from the clean section of the upper steam drum and an output terminal connected to a delivery steam pipe that delivers superheated steam flow output from the superheater to an injection well of a Steam Assisted Gravity Drainage (SAGD) process or to a turbine; and a temperature control device comprising an attemperator connected with the output terminal of the superheater and an actuated valve, the attemperator configured to inject attemperation fluid into the superheated steam flow output from the output terminal of the superheater and the actuated valve controlling a flow rate of the attemperation fluid into the superheated steam flow to provide temperature control.

2. The boiler of claim 1 wherein:

the attemperator is configured to inject the attemperation fluid comprising steam into the superheated steam flow output from the output terminal of the superheater.

3. The boiler of claim 1 wherein:

the attemperator is connected with the concentrated section of the upper steam drum to receive the attemperation fluid comprising concentrated steam from the concentrated section of the upper steam drum.

4. The boiler of claim 1 wherein the boiler includes a furnace section and a boiler section defining a heated gas flow path along which heated gas passes through the furnace section and then through the boiler section, the steam-water tubes being disposed in the boiler section, and the superheater being disposed in the boiler section.

5. The boiler of claim 1 wherein:

the boiler includes a furnace section and a boiler section defining a heated gas flow path along which heated gas passes through the furnace section and then through the boiler section, the steam-water tubes being disposed in the boiler section; and the steam-water tubes are arranged into a plurality of banks of steam-water tubes in the boiler section with the banks spaced apart along the heated gas flow path, and the superheater is disposed in the boiler section and replaces at least the inner tubes of a bank of steam-water tubes in the boiler section.

6. The boiler of claim 1 wherein the boiler includes a furnace section and a boiler section defining a heated gas flow path along which heated gas passes through the furnace section and then through the boiler section, the steam-water tubes being disposed in the boiler section, and the superheater is disposed in the furnace section.

7. The boiler of claim 1 wherein the boiler includes a furnace section and a boiler section defining a heated gas flow path along which heated gas passes through the furnace section and then through the boiler section, the steam-water tubes being disposed in the boiler section, and the boiler further comprises:

a superheater module housing containing the superheater, the superheater module housing connected with an outlet of the heated gas flow path, the superheater module housing defining a sealed conduit continuing the heated gas flow path past the outlet.

8. The boiler of claim 7 wherein the sealed conduit defined by the superheater module housing connects the outlet with an economizer.

9. The boiler of claim 1 wherein the superheater does not have an input terminal connected with the lower drum.

10. The boiler of claim 9 further comprising:

an intermediate drum;

wherein the steam-water tubes connect the lower drum with the intermediate drum and the intermediate drum is connected with the upper steam drum by risers whereby the steam-water tubes are connected to convey a steam-water mixture from the lower drum into the upper steam drum via the intermediate drum;

wherein the superheater does not have an input terminal connected with the intermediate drum.

11. A boiler comprising:

an upper steam drum that includes an internal divider which divides the upper steam drum into a clean section and a concentrated section;

a lower drum;

downcomers connecting the upper steam drum to the lower drum;

steam-water tubes connecting the lower drum with one of:

(i) an intermediate drum connected with the upper steam drum by risers; or (ii) the upper steam drum wherein the boiler does not include an intermediate drum connected with the upper steam drum by risers;

a superheater having an input terminal connected to receive steam from the clean section of the upper steam drum and an output terminal connected to a delivery steam pipe that delivers superheated steam flow output from the superheater to an injection well of a Steam Assisted Gravity Drainage (SAGD) process or to a turbine; and a temperature control device comprising an attemperator connected with the output terminal of the superheater and an actuated valve, the attemperator further connected with the concentrated steam section of the upper steam drum to inject concentrated steam from the concentrated steam section of the upper steam drum into the superheated steam flow output from the output terminal of the superheater, and the actuated valve controlling a flow rate of the concentrated steam from the concentrated steam section of the upper steam drum into the superheated steam flow to provide temperature control.

12. The boiler of claim 11 wherein the boiler includes a furnace section and a boiler section defining a heated gas flow path along which heated gas passes through the furnace section and then through the boiler section, the steam-water tubes being disposed in the boiler section, and the superheater is disposed in the boiler section.

13. The boiler of claim 11 wherein:

the boiler includes a furnace section and a boiler section defining a heated gas flow path along which heated gas passes through the furnace section and then through the boiler section, the steam-water tubes being disposed in the boiler section;

the steam-water tubes are arranged into a plurality of banks of tubes in the boiler section with the banks spaced apart along the heated gas flow path; and the superheater is disposed in the boiler section and replaces at least the inner tubes of a bank in the boiler section.

14. The boiler of claim 11 wherein the boiler includes a furnace section and a boiler section defining a heated gas flow path along which heated gas passes through the furnace section and then through the boiler section, the steam-water tubes being disposed in the boiler section, and the superheater is disposed in the furnace section.

15. The boiler of claim 11 wherein the boiler includes a furnace section and a boiler section defining a heated gas flow path along which heated gas passes through the furnace section and then through the boiler section, the steam-water tubes being disposed in the boiler section, and the boiler further comprises:

a superheater module housing containing the superheater, the superheater module housing connected with an outlet of the heated gas flow path, the superheater module housing defining a sealed conduit continuing the heated gas flow path past the outlet.

16. The boiler of claim 15 wherein the sealed conduit defined by the superheater module housing connects the outlet with an economizer.

17. The boiler of claim 11 wherein the superheater does not have an input terminal connected with the lower drum.

18. The boiler of claim 17 wherein the steam-water tubes connect the lower drum with an intermediate drum and the intermediate drum is connected with the upper steam drum by risers, and the superheater does not have an input terminal connected with the intermediate drum.

19. The boiler of claim 18 wherein the upper steam drum, the intermediate drum, and the lower drum are vertically aligned with each other.

20. A boiler comprising:

an upper steam drum having an internal divider which divides the upper steam drum into a clean section and a concentrated section;

a clean lower drum;

a concentrated lower drum;

clean downcomers connecting the clean section of the upper steam drum to the clean lower drum;

concentrated downcomers connecting the concentrated section of the upper steam drum to the concentrated lower drum;

steam-water tubes connected to convey a steam-water mixture from the clean lower drum to the clean section of the upper steam drum and to convey a steam-water mixture from the concentrated lower drum to the clean section of the upper steam drum; and a superheater having an input terminal connected to receive steam from the clean section of the upper steam drum, the superheater being interspersed among the steam-water tubes.

21. The boiler of claim 20 further comprising:

a clean intermediate drum; and a concentrated intermediate drum;

wherein the steam-water tubes connect the clean lower drum with the clean intermediate drum and the clean intermediate drum is connected with the clean section of the upper steam drum by risers whereby the steam-water tubes are connected to convey a steam-water mixture from the clean lower drum into the clean section of the upper steam drum via the clean intermediate drum; and wherein the steam-water tubes connect the concentrated lower drum with the concentrated intermediate drum and the concentrated intermediate drum is connected with the concentrated section of the upper steam drum by risers whereby the steam-water tubes are connected to convey a steam-water mixture from the concentrated lower drum into the concentrated section of the upper steam drum via the concentrated intermediate drum.

22. The boiler of claim 20 wherein the superheater further has an output terminal connected to a delivery steam pipe that delivers superheated steam flow output from the superheater to an injection well of a Steam Assisted Gravity Drainage (SAGD) process or to a turbine, and the boiler further comprises:

a temperature control device comprising an attemperator connected with the output terminal of the superheater and an actuated valve, the attemperator configured to inject attemperation fluid into the superheated steam flow output from the output terminal of the superheater and the actuated valve controlling a flow rate of the attemperation fluid into the superheated steam flow to provide temperature control.

23. The boiler of claim 22 wherein the attemperator is connected with the concentrated section of the upper steam drum to receive the attemperation fluid comprising concentrated steam from the concentrated section of the upper steam drum.

* * * * *